US009861240B2

(12) United States Patent
Jenson

(10) Patent No.: US 9,861,240 B2
(45) **Date of Patent: *Jan. 9, 2018**

(54) BATTERY REMOVAL FOR A VACUUM CLEANER

(71) Applicant: Techtronic Industries Co. Ltd., Tsuen Wan, New Territories (HK)

(72) Inventor: Steven Jenson, Chagrin Falls, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,806

(22) Filed: Aug. 17, 2016

(65) Prior Publication Data

US 2016/0353952 A1 Dec. 8, 2016

Related U.S. Application Data

(63) Continuation of application No. 14/885,717, filed on Oct. 16, 2015, now Pat. No. 9,439,548.

(60) Provisional application No. 62/064,864, filed on Oct. 16, 2014.

(51) Int. Cl.

| | |
|---|---|
| ***A47L 9/28*** | (2006.01) |
| ***A47L 5/22*** | (2006.01) |
| ***A47L 9/24*** | (2006.01) |
| ***A47L 5/24*** | (2006.01) |
| ***A47L 5/28*** | (2006.01) |
| ***A47L 9/32*** | (2006.01) |
| ***A47L 9/04*** | (2006.01) |

(52) U.S. Cl.

CPC ..... *A47L 5/225* (2013.01); *A47L 5/24* (2013.01); *A47L 5/28* (2013.01); *A47L 9/0477* (2013.01); *A47L 9/24* (2013.01); *A47L 9/2884* (2013.01); *A47L 9/322* (2013.01); *A47L 9/325* (2013.01)

(58) Field of Classification Search

CPC ..... A47L 5/24; A47L 5/28; A47L 9/24; A47L 9/322; A47L 5/225; A47L 9/2884; A47L 9/28

USPC ..... 15/329, 339, DIG. 1

See application file for complete search history.

(56) References Cited

U.S. PATENT DOCUMENTS

| | | | |
|---|---|---|---|
| 6,839,934 | B2 | 1/2005 | Houghton et al. |
| D615,717 | S | 5/2010 | Butts et al. |
| D620,652 | S | 7/2010 | Butts et al. |
| 7,882,593 | B2 | 2/2011 | Beskow et al. |
| D652,377 | S | 1/2012 | Butts et al. |

(Continued)

FOREIGN PATENT DOCUMENTS

| | | |
|---|---|---|
| GB | 2269475 | 2/1994 |
| WO | 2008088278 | 7/2008 |

(Continued)

OTHER PUBLICATIONS

International Search Report and Written Opinion for Application No. PCT/U52015/056046 dated Feb. 15, 2016 (12 pages).

*Primary Examiner* — David Redding

(74) *Attorney, Agent, or Firm* — Michael Best & Friedrich LLP

(57) ABSTRACT

A vacuum cleaner includes a vacuum component defining an aperture, and a hand vacuum including a removable battery. The hand vacuum is in removable engagement with the vacuum component, and the battery is removable from the hand vacuum through the aperture while the hand vacuum remains in engagement with the vacuum component.

20 Claims, 9 Drawing Sheets

(56) References Cited

U.S. PATENT DOCUMENTS

| | | | |
|---|---|---|---|
| 8,151,411 | B2 | 4/2012 | Beskow et al. |
| 8,225,456 | B2 | 7/2012 | Hakan et al. |
| 8,302,251 | B2 | 11/2012 | Beskow et al. |
| 8,424,154 | B2 | 4/2013 | Beskow et al. |
| 8,607,405 | B2 | 12/2013 | Reed et al. |
| 8,607,406 | B2 | 12/2013 | Miefalk et al. |
| 8,671,509 | B2 | 3/2014 | Reed et al. |
| 8,671,510 | B2 | 3/2014 | Han et al. |
| 9,439,548 | B2 * | 9/2016 | Jenson ..... A47L 9/0477 |
| 2007/0136984 | A1 | 6/2007 | Hsu |
| 2007/0251048 | A1 | 11/2007 | Choi |
| 2008/0040883 | A1 | 2/2008 | Beskow et al. |
| 2009/0255084 | A1 | 10/2009 | Gee, II et al. |
| 2010/0192314 | A1 | 8/2010 | Otsuka et al. |
| 2011/0289720 | A1 | 12/2011 | Han et al. |
| 2013/0139348 | A1 | 6/2013 | Otsuka et al. |
| 2013/0152333 | A1 | 6/2013 | Reed et al. |
| 2013/0276258 | A1 | 10/2013 | Amann |

FOREIGN PATENT DOCUMENTS

| | | |
|---|---|---|
| WO | 2010040523 | 4/2010 |
| WO | 2014141780 | 9/2014 |

* cited by examiner

BATTERY REMOVAL FOR A VACUUM CLEANER

CROSS-REFERENCE TO RELATED APPLICATIONS

This application is a continuation of U.S. patent application Ser. No. 14/885,717, filed Oct. 16, 2015, which claims priority to U.S. Provisional Patent Application No. 62/064,864, filed on Oct. 16, 2014, the entire contents all of which are hereby incorporated by reference.

FIELD OF THE INVENTION

The present invention relates to a vacuum cleaner. More specifically, the present invention relates to a vacuum component that carries a detachable hand vacuum, the hand vacuum includes a battery that is removable without detaching the hand vacuum from the vacuum component.

BACKGROUND OF THE INVENTION

A vacuum cleaner is generally known in the art. A vacuum cleaner is a cleaning device that creates a partial vacuum using air to suction dust, dirt, or other debris from a surface. The vacuum cleaner typically draws a combination of air and dust, dirt, or other debris into the cleaner through a floor nozzle. This "dirty air" typically enters a dust separator in the vacuum that separates the dust, dirt, or debris from the air. A bin or bag collects the separated dust, dirt, or debris separated from the air for later disposal. The resulting "clean air" exits the dust separator where it is exhausted from the vacuum cleaner.

SUMMARY OF THE INVENTION

The invention provides, in one aspect, a vacuum cleaner including a vacuum component defining an aperture, and a hand vacuum including a removable battery. The hand vacuum is in removable engagement with the vacuum component, and the battery is removable from the hand vacuum through the aperture while the hand vacuum remains in engagement with the vacuum component.

The invention provides, in another aspect, a multi-component vacuum cleaner including a vacuum component defining an aperture, and a hand vacuum removably coupled to the vacuum component, the hand vacuum carrying a removable battery. The battery is removable from the hand vacuum through the aperture while the hand vacuum remains coupled to the vacuum component.

The invention provides, in another aspect, a method of removing a battery from a hand vacuum removably coupled to a vacuum component without separating the hand vacuum from the vacuum component including accessing the battery through an aperture provided in the vacuum component, detaching the battery from the hand vacuum, and removing the battery through the aperture.

Other features and aspects of the invention will become apparent by consideration of the following detailed description and accompanying drawings.

Figure 1:
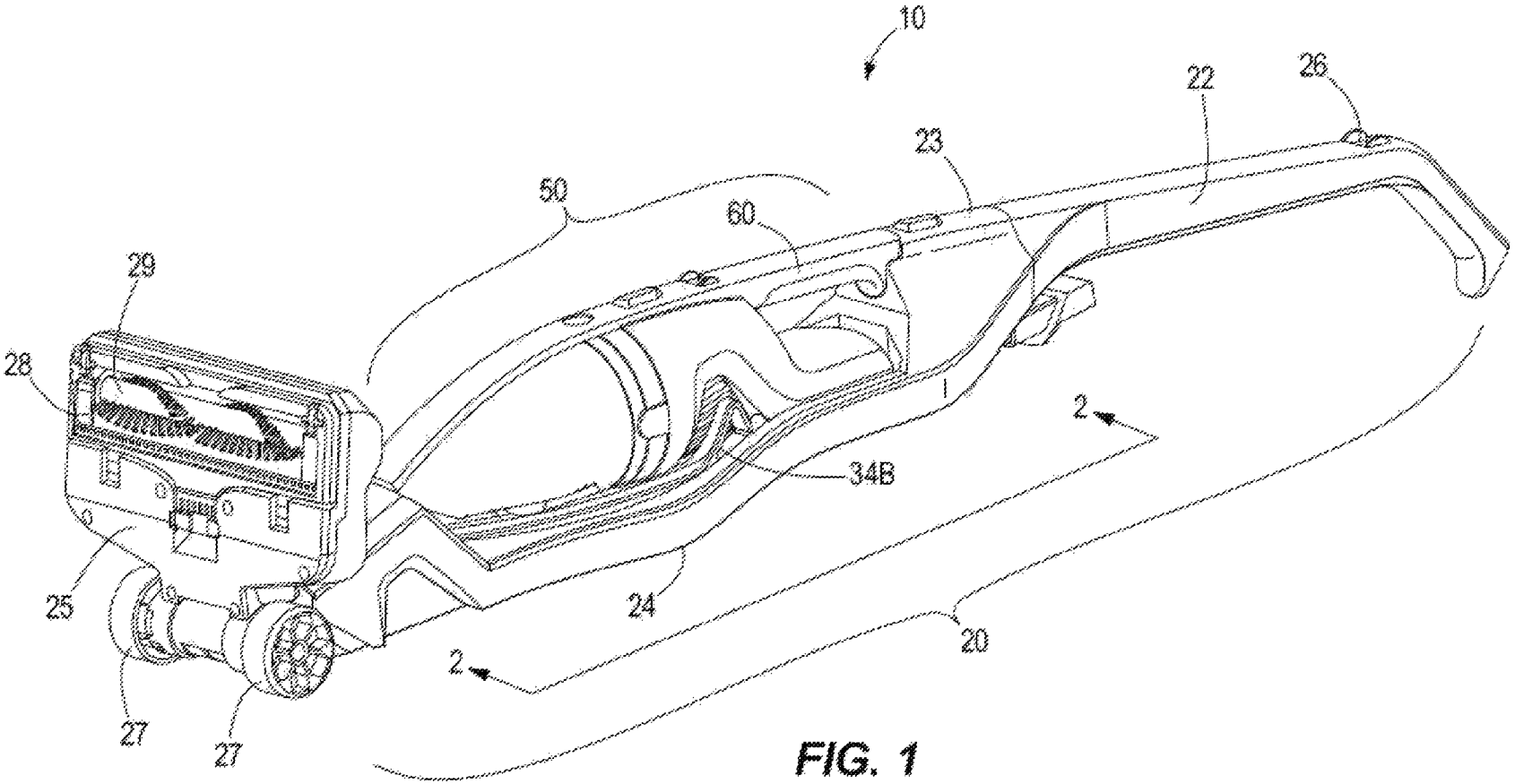
FIG. 1 is an isometric view of an example of an embodiment of a vacuum cleaner that includes an upright portion carrying a removable hand vacuum.

Before any embodiments of the present invention are explained in detail, it should be understood that the invention is not limited in its application to the details or construction and the arrangement of components as set forth in the following description or as illustrated in the drawings. The invention is capable of other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

The invention illustrated in the Figures and disclosed herein is generally directed to a vacuum cleaner 10, 10A having a vacuum component 20 that receives and carries a detachable hand vacuum 50. The hand vacuum 50 carries a hand vacuum battery 70 that provides power to operate only the hand vacuum 50 when detached from the vacuum component 20, and both the hand vacuum 50 and the vacuum component 20 when attached to the vacuum component 20. The battery 70 is removable from the hand vacuum 50 while the hand vacuum 50 remains attached to the vacuum component 20. Stated another way, the hand vacuum 50 does not have to be removed from the vacuum component 20 to remove the battery 70. To facilitate removal while the vacuum component 20 carries the hand vacuum 50, the vacuum component 20 (or a portion of the vacuum component 20) defines an access aperture 40 that provides access to the battery 70. The battery 70 is removable from the hand vacuum 50 through the aperture 40 (or through the vacuum component 20), advantageously providing a user with fast, simple, and easy removal of the battery 70 from the vacuum cleaner 10, 10A. Once removed, the battery can be charged or recharged (i.e., the battery 70 is a rechargeable battery), or replaced. The battery 70 can also be attached (or reattached) to the hand vacuum 50 through the aperture 40 (or through the vacuum component 20).

For ease of discussion and understanding, the following detailed description will refer to a vacuum cleaner 10, 10A, but illustrates the vacuum cleaner 10, 10A as a multi-component vacuum that includes the hand vacuum 50 removably coupled to (or removably received by) the vacuum component 20, illustrated as an upright or upright portion 20. It should be appreciated that the term "vacuum cleaner" is inclusive, and refers to any vacuum that incorporates the removable battery innovation disclosed herein, including, but not limited to, a stick vacuum, an upright vacuum, a two-in-one vacuum, a canister vacuum, and/or a vacuum component that receives, attaches to, or otherwise connects to the hand vacuum 50. Further, while the vacuum component 20 is illustrated as an upright or upright portion 20, the term "vacuum component" is inclusive, and refers to any component of a vacuum cleaner that incorporates the removable battery innovation disclosed herein. An example of a component of a vacuum can include, but is not limited to, an upright, a portion of a stick vacuum, a portion of a two-in-one vacuum, a portion of a canister vacuum, a crevice tool, and/or any other suitable components, accessories, or portion of a vacuum that receives, attaches to, or otherwise connects to the hand vacuum 50.

In addition, it should be appreciated that as used in the present description and claims, the terms "upright" or "upright portion" are directed to a vacuum component that connects to the hand vacuum 50, and further may utilize a suction source 54 of the hand vacuum 50. The terms "upright" or "upright portion" as used herein are provided as a non-limiting example of a vacuum component. In other embodiments, the upright portion 20 may include any suitable vacuum component that receives, attaches to, or otherwise connects to the hand vacuum 50, and further that may utilize the suction source 54 of the hand vacuum 50 to operate.

It should also be appreciated that the term "dust" is directed to dust, dirt, particulate, debris, or any other material that may be drawn into the vacuum cleaner 10 with air as dirty air. In addition, the term "surface" may include carpeting, flooring, concrete, or any other material from which the vacuum cleaner 10 may remove dust from.

Referring now to the Figures, FIGS. 1-7 illustrate an example of an embodiment of a vacuum cleaner 10. Referring to FIG. 1, the vacuum cleaner 10 is shown as a multi-component vacuum 10 having a first component or first vacuum component or upright portion 20 and a second component or second vacuum component or hand vacuum 50. The hand vacuum 50 engages the upright portion 20 such that the hand vacuum 50 is in removable engagement with, removably received by, or removably coupled to the upright portion 20. Stated otherwise, the upright portion 20 receives and retains the hand vacuum 50 until the user disengages or removes the hand vacuum 50 from the upright portion 20. The vacuum cleaner 10 is operable in at least two cleaning modes. In a first cleaning mode, a user operates the vacuum cleaner 10 on a surface with the hand vacuum 50 in engagement with the upright portion 20. In a second cleaning mode, the hand vacuum 50 is detached from the upright portion 20. A user is then free to operate the hand vacuum 50 separately from the upright portion 20, for example to vacuum a targeted portion of the surface or to use with other accessories or vacuum components.

The upright portion 20 includes a handle 22 having a first side 23 opposite a second side 24. The handle 22 is pivotally connected to a nozzle or floor engaging portion 25 to provide angle adjustment between the handle 22 and nozzle 25 during operation to maintain nozzle 25 contact with the surface being vacuumed. The nozzle 25 can include a pair of wheels 27 to facilitate movement of the nozzle 25 along the surface being vacuumed. The nozzle 25 includes a dirty air inlet 28 that can optionally carry an agitating unit 29. The agitating unit 29 can include a brush roll 29 or other suitable agitator. The brush roll 29 agitates the surface to facilitate dust removal from the surface. The brush roll 29 can be driven by a brush roll motor (not shown) in the floor engaging portion 25, can be driven by suction air flowing through a turbine (not shown), or can be free to rotate by suction air flowing through the dirty air inlet 28. The upright portion 20 further includes a power switch 26 that is operable to initiate or terminate operation of the vacuum 10. In the illustrated embodiment, the power switch 26 is operably connected to the hand vacuum 50 to initiate or terminate operation of the hand vacuum 50 while attached to the upright portion 20.

Figure 2:
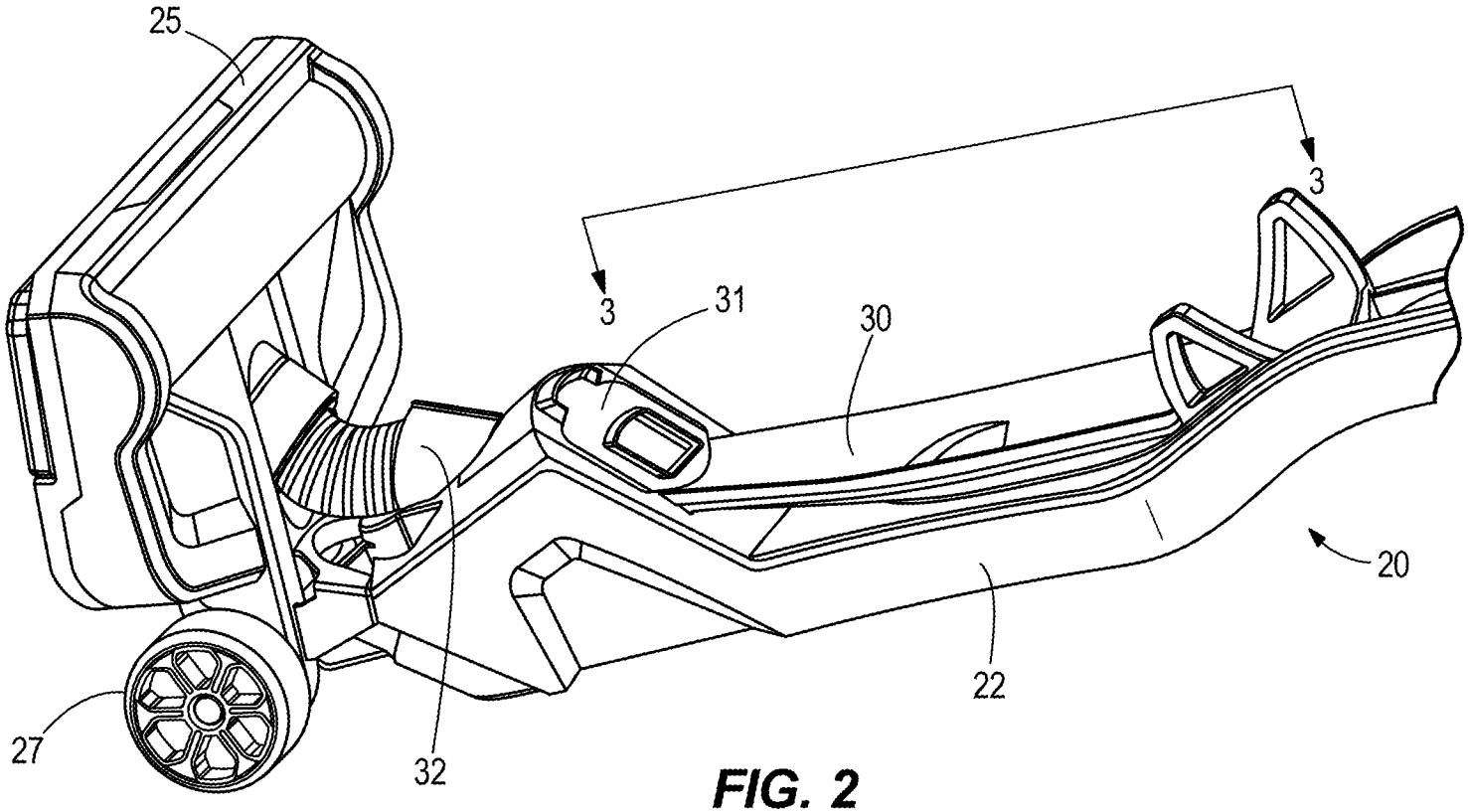
FIG. 2 is a partial side view of the vacuum of FIG. 1, with the hand vacuum removed from the upright portion and taken along line 2-2 of FIG. 1, illustrating a hand vacuum cradle.
Figure 3:
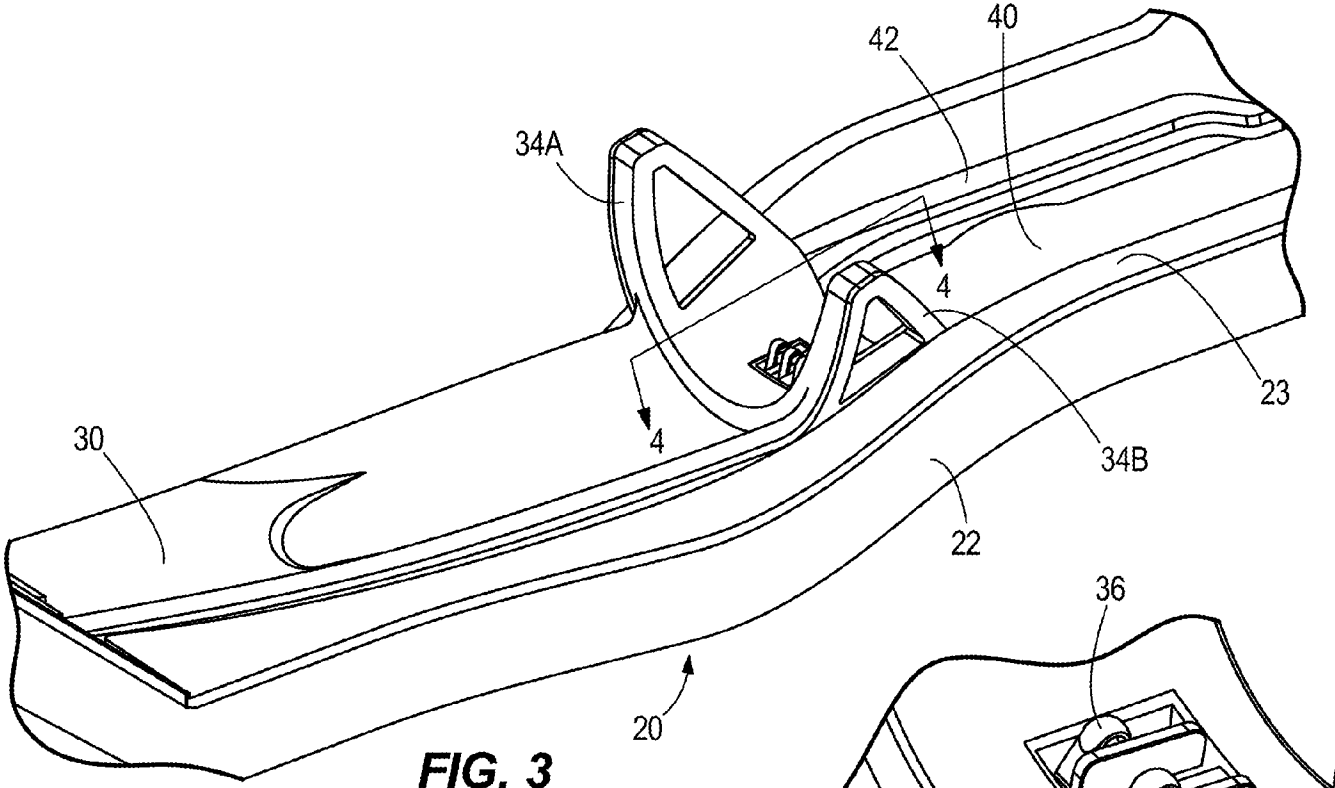
FIG. 3 is an isometric view of a portion of the hand vacuum cradle, taken along line 3-3 of FIG. 2, and illustrating the hand vacuum cradle and a battery access aperture.
Figure 8:
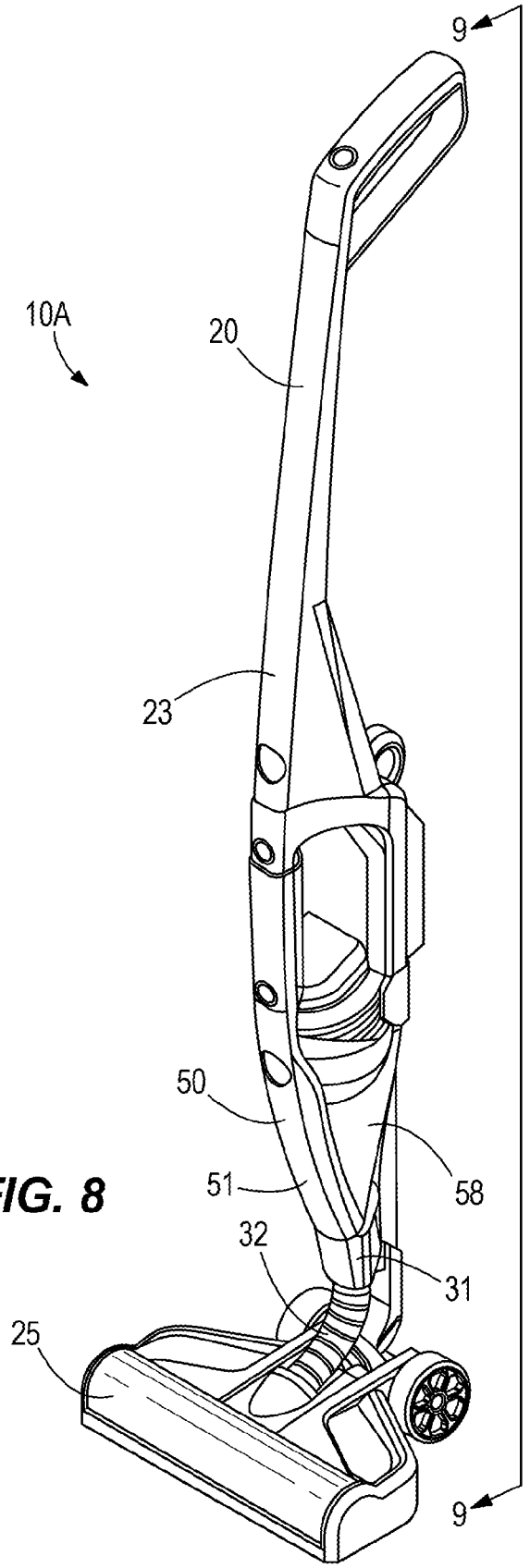
FIG. 8 is an isometric view of another example of an embodiment of a vacuum cleaner that includes an upright portion carrying a removable hand vacuum.

Referring now to FIGS. 2-3, the handle 22 of the illustrated embodiment includes a hand vacuum cradle 30 that is configured to receive and retain the hand vacuum 50 (shown in FIG. 1) with the upright portion 20. As illustrated in FIG. 2, the cradle 30 includes a sealing surface 31 that forms a fluid connection between the nozzle 25 and a suction inlet 52 (shown in FIGS. 5-6) of the hand vacuum 50. The dirty air inlet 28 (shown in FIG. 1) of the nozzle 25 is in fluid connection with the sealing surface 31 by a conduit 32. The conduit 32 directs airflow from the dirty air inlet 28 of the floor engaging portion 25 to an attached hand vacuum 50. Thus, dirty air drawn into the dirty air inlet 28 of the floor engaging portion 25 travels through the conduit 32 and into the suction inlet 52 of the hand vacuum 50. The sealing surface 31 can be any suitable surface to facilitate formation of a seal between the hand vacuum 50 suction inlet 52 and the upright portion 20. For example, a portion of the sealing surface 31 can be received by the suction inlet 52 (as illustrated in FIG. 2), a portion of the sealing surface 31 can receive a portion of a housing 51 of the hand vacuum 50 around the suction inlet 52, such as a portion of a dust cup 58 (as illustrated in FIG. 8), and/or a portion of the sealing surface 31 can engage a portion of a housing 51 that surrounds or is proximate to the suction inlet 52.

Referring to FIG. 3, the cradle 30 may include opposing retention members 34A, 34B that receive and stabilize the hand vacuum 50 when received by the cradle 30. When mounted to the cradle 30 of the illustrated embodiment, the hand vacuum 50 is received between the opposing retention members 34A, 34B (see FIG. 1). The retention members 34A, 34B stabilize the hand vacuum 50, and assist against unintentional disengagement of the hand vacuum 50 from the upright portion 20.

Figure 4:
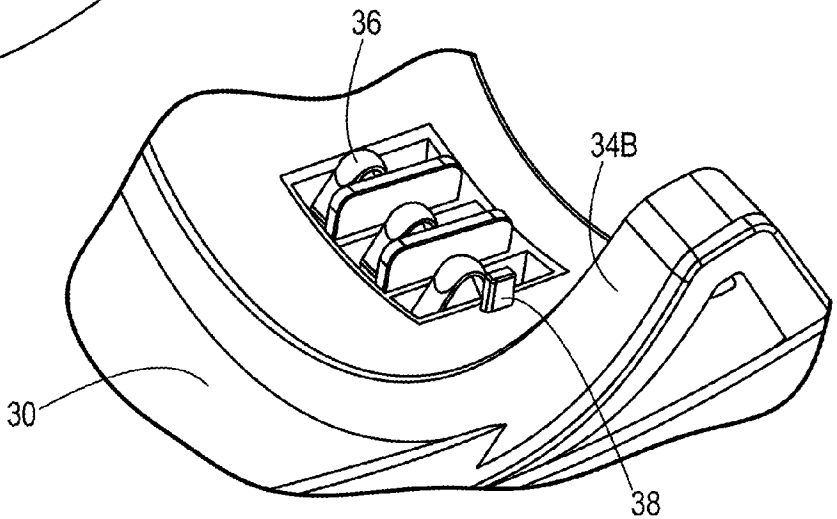
FIG. 4 is an isometric view of a portion of the hand vacuum cradle, taken along line 4-4 of FIG. 3, illustrating an electrical contact and a bypass switch tab that are configured to engage a portion of the hand vacuum.

In certain embodiments, the upright portion or vacuum component 20 can receive power from the hand vacuum 50, such as for operating a brush roll motor (not shown) or other electric features. As shown in FIG. 4, the cradle 30 of the illustrated embodiment includes a first electrical contact or contacts 36. When the hand vacuum 50 is received by the cradle 30, the first electrical contact 36 engages a corresponding second electrical contact or contacts 66 positioned on the hand vacuum 50 (shown in FIG. 7). A projection or switch arm 38 on the upright portion 20, and more specifically the cradle 30 (shown in FIG. 4), is configured to engage a switch 68 positioned on the hand vacuum 50

Figure 7:
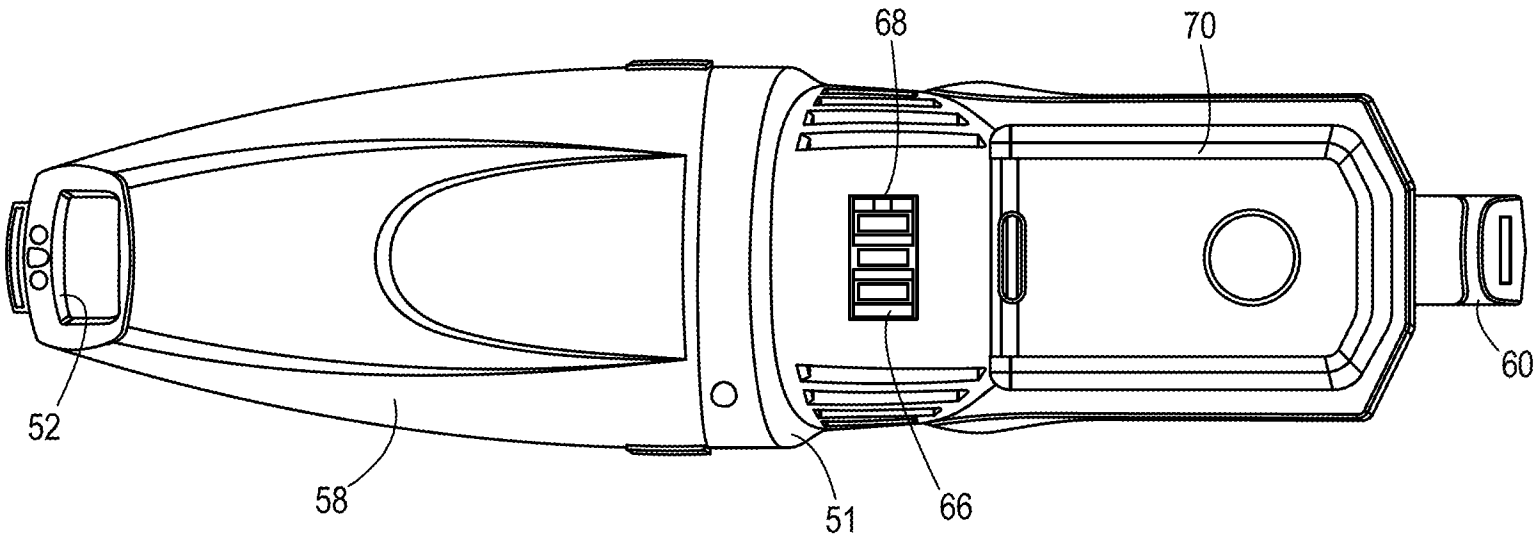
FIG. 7 is a bottom plan view of the hand vacuum of FIG. 5, taken along line 7-7 of FIG. 5.

(shown in FIG. 7). When the hand vacuum 50 is attached to the vacuum component 20, the projection 38 engages the switch 68 to direct electricity from the battery 70 (carried by the hand vacuum 50), through the second electrical contact 66, and to the first electrical contact 36. From the first electrical contact 36, electricity is distributed to provide power to one or more electrical features in the vacuum component 20.

Referring back to FIG. 3, the upright portion or vacuum component 20 defines an aperture 40. The aperture 40 extends between the first and second sides 23, 24 of the upright portion 20. A rim 42 can extend around a portion of a perimeter of the aperture 40. The aperture 40 can be positioned adjacent the cradle 30 such that when the hand vacuum 50 is received by the cradle 30, the battery 70 is positioned into alignment with aperture 40. In addition, a portion of the battery 70 can extend through aperture 40 (shown in FIG. 9). Stated another way, the aperture 40 can receive a portion of the battery 70. When aligned with and/or received by aperture 40, the battery 70 is accessible and removable through the upright portion 20 while the hand vacuum 50 remains attached to the upright portion 20. As a non-limiting example, and referring to FIGS. 1 and 3, the hand vacuum 50 engages the upright portion 20. During engagement, the battery 70 passes from the first side 23 of the upright portion 20, and into the aperture 40. Once the hand vacuum 50 is engaged with the upright portion 20, the battery 70 is accessible and removable through the aperture 40 and out the second side 24 of the upright portion 20. The battery 70 is removable through the upright portion 20 (through the aperture 40) and out the second side 24 without requiring disengagement of the hand vacuum 50 from the upright portion 20.

Figure 5:
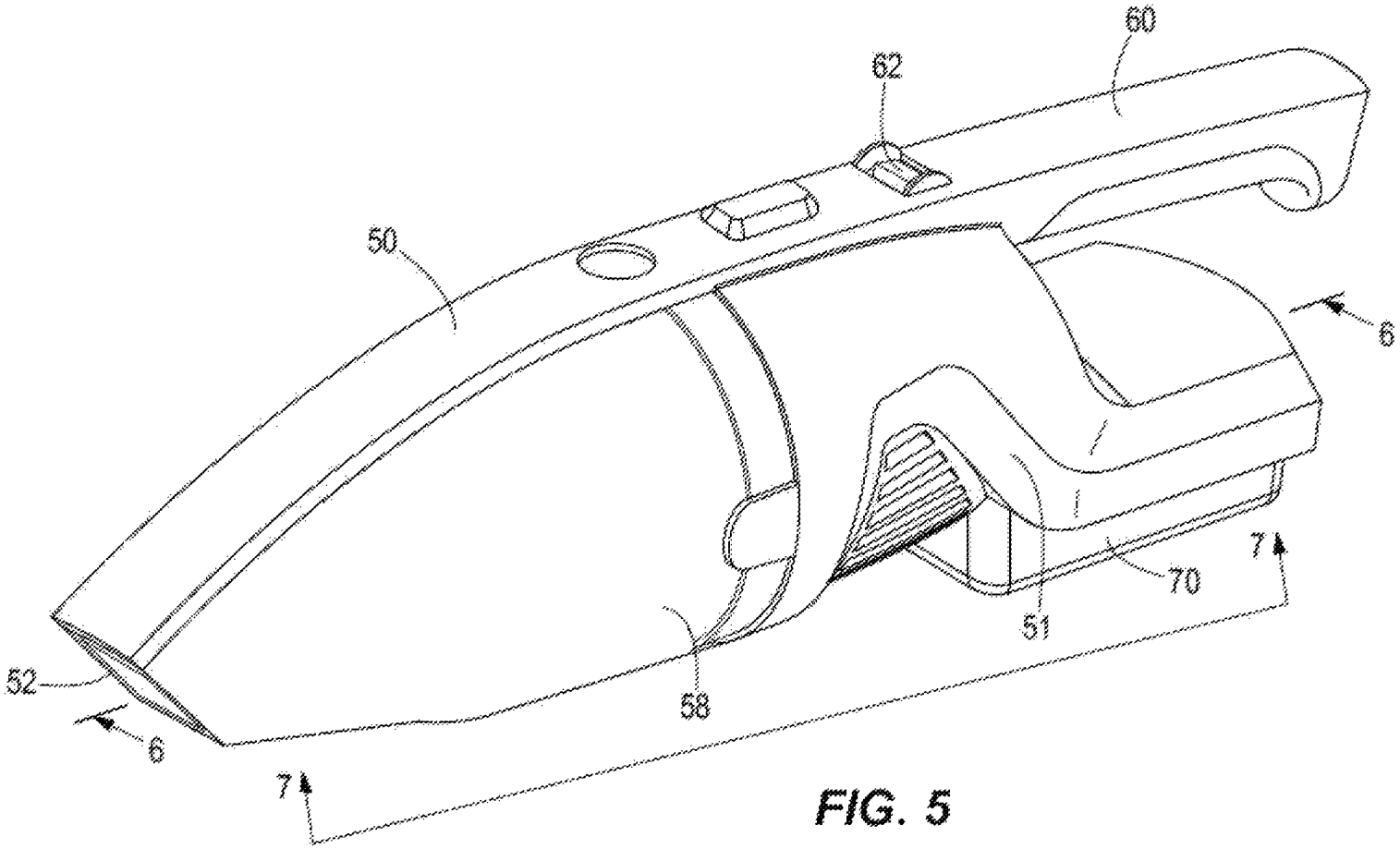
FIG. 5 is an isometric view of the hand vacuum that is configured to engage the upright portion to form the vacuum cleaner of FIG. 1.
Figure 6:
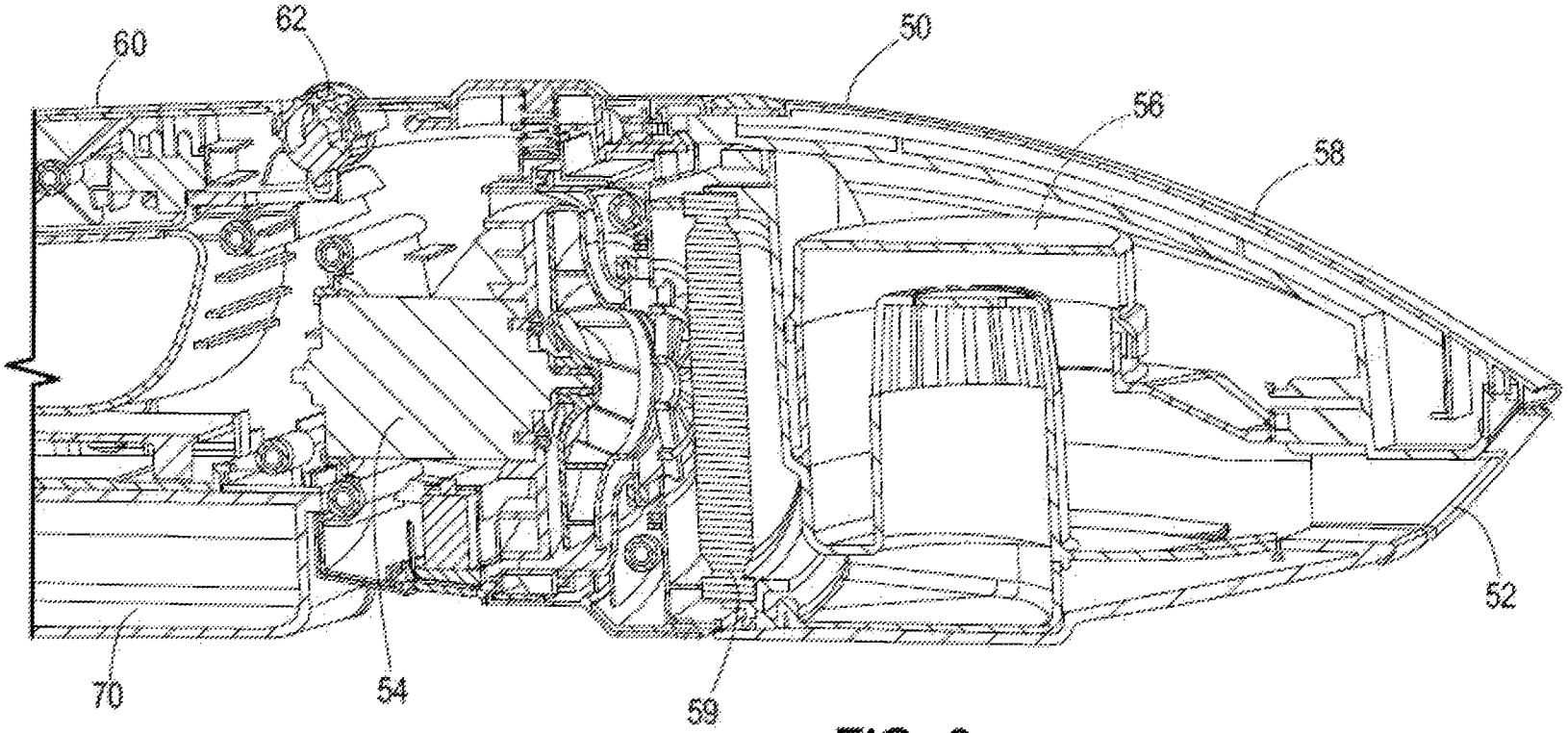
FIG. 6 is a partial cross sectional view of the hand vacuum of FIG. 5, taken along line 6-6 of FIG. 5.

Referring now to FIGS. 5-7, an example of an embodiment of the hand vacuum 50 is illustrated. The hand vacuum 50 includes a housing 51 that defines the hand vacuum 50. The suction inlet 52 provides access into the housing 51, and is in a fluid connection with (or fluidly connected to) a suction source 54 by a flow path. The suction source 54 is shown in FIG. 6 as a suction motor 54. A separator 56, shown in FIG. 6, is disposed in the flow path between the suction inlet 52 and the suction motor 54. The separator 56 separates dust from dirty air drawn into the hand vacuum 50 through the suction inlet 52. The separated dust is retained in a dust cup 58 for collection and later disposal. To facilitate disposal, the dust cup 58 is removable from the hand vacuum 50. The resulting clean air exits the separator 56 and travels along the flow path to the suction motor 54. The clean air can pass through a filter 59 before reaching the suction motor 54. At the suction motor 54, the clean air can be used for motor cooling before being exhausted out of the housing 51. In the illustrated embodiment, the separator 56 is shown as a cyclonic separator. However, in other embodiments, the separator 56 can be any suitable known or future developed device for separating dust from dirty air, including, but not limited to a filter, a bag, or other suitable separator for removing dust, dirt, or other particulates from air.

As shown in FIGS. 5-6, the housing 51 includes a handle 60 to facilitate user operation of the hand vacuum 50. A power switch 62 is positioned on the housing 51 and in proximity to the handle 60 to allow a user to selectively turn on and off the hand vacuum 50. The removable battery 70 is also connected to the housing 51. As illustrated in FIGS. 5-7, the battery 70 is positioned on the housing 51 opposite the handle 60. However in other embodiments, the battery 70 may be connected to the housing 51 at any suitable or desired location.

Figure 9:
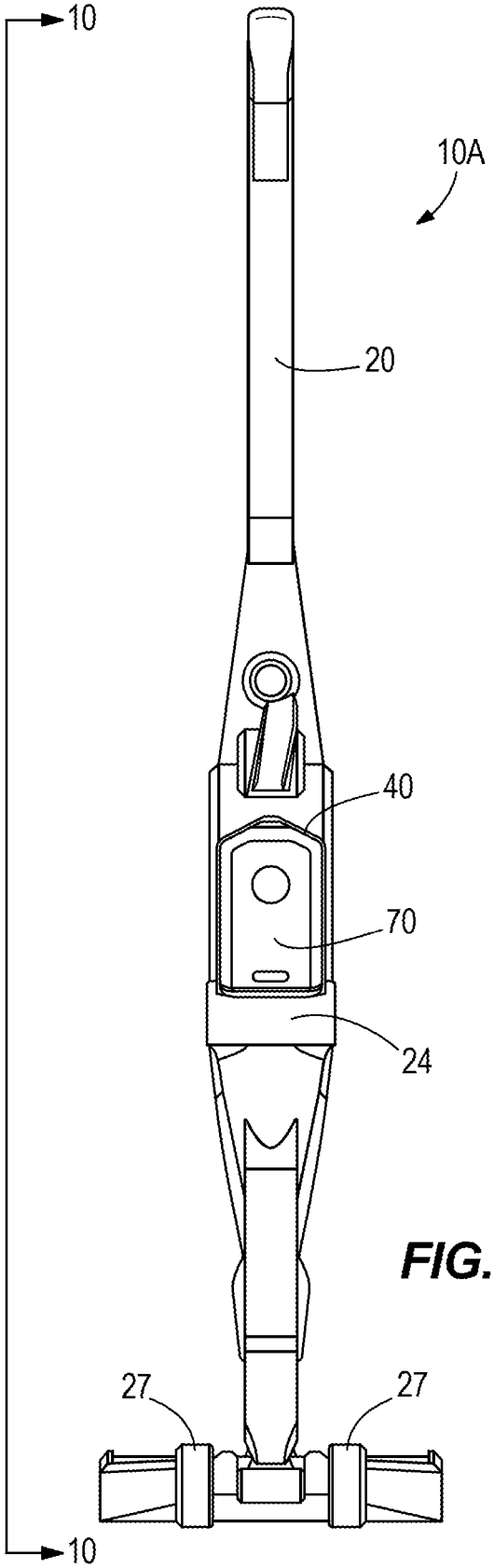
FIG. 9 is an elevation view of the vacuum cleaner of FIG. 8, taken along line 9-9 of FIG. 8, illustrating the hand vacuum battery accessible through an aperture defined by the upright portion.
Figure 10:
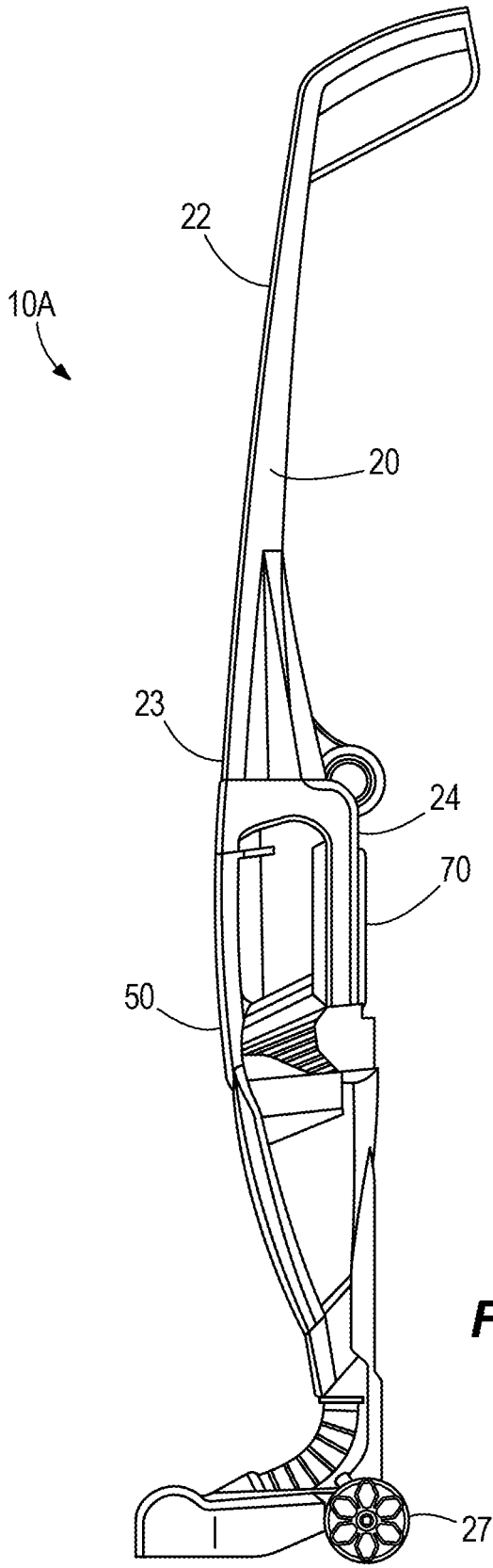
FIG. 10 is a side view of the vacuum cleaner of FIG. 8, taken along line 10-10 of FIG. 9, illustrating the hand vacuum battery accessible through the aperture defined by the upright portion.

FIGS. 8-10 illustrate an alternative embodiment of a vacuum cleaner 10A that incorporates the removable battery innovation disclosed herein. The vacuum cleaner 10A includes similar components as vacuum cleaner 10, with like numbers identifying like components.

In operation and use, the user may operate the vacuum cleaner 10 in the first cleaning mode (or a first cleaning configuration) with the hand vacuum 50 attached to the upright portion 20, and the second cleaning mode (or a second cleaning configuration), with the hand vacuum 50 detached from the upright portion 20. To operate in the first cleaning mode, the hand vacuum 50 is connected to the upright portion 20 (as shown in FIGS. 1 and 8). Operation of the vacuum cleaner 10 is then initiated, for example by actuation of the power switch 26 on the upright portion 20, or the power switch 62 on the hand vacuum 50. The nozzle can then be maneuvered along the floor or other surface as desired, for example through the handle 22.

In the second cleaning mode, or handheld cleaning mode, the hand vacuum 50 is detached from the upright portion 20. The hand vacuum 50 is removed from the cradle 30. Prior to or after removal, the hand vacuum 50 can be powered on (e.g., by actuating the power switch 62). Once detached and powered (i.e., operable to generate a vacuum), the hand vacuum 50 can be used to vacuum a surface by grasping the hand vacuum 50 (e.g., by the handle 60). Upon completion of handheld cleaning, the hand vacuum 50 can be reengaged with the upright portion 20. During reengagement, the hand vacuum 50 is positioned in the cradle 30. During positioning in the cradle 30, the battery 70 can be aligned with the aperture 40. The cradle 30 receives the hand vacuum 50, and the aperture 40 can receive a portion of the battery 70.

Once the hand vacuum 50 is attached to (or received by) the upright portion 20, the battery 70 can be removed from the hand vacuum 50 without requiring disengagement of the hand vacuum 50 from the upright portion 20. A user has access to the battery 70 through the aperture 40 defined by the upright portion 20 (or a portion of the upright portion 20). The access allows the user to disconnect the battery 70 from the hand vacuum 50 and remove the battery through the aperture 40. Stated another way, the battery 70 is removable from the hand vacuum 50 through the upright portion 20, while the hand vacuum 50 remains connected to (or engaged with or received by) the upright portion 20. It should be appreciated that the battery 70 is also removable from the hand vacuum 50 when the hand vacuum 50 is disconnected from (or disengaged with) the upright portion 20.

By providing a combination vacuum component 20 and hand vacuum 50 that allows for removal of the hand vacuum battery 70 without first disengaging the hand vacuum 50 from the vacuum component 20, the vacuum cleaner 10, 10A advantageously provides a user with a fast, simple, and easily removable battery 70. This improves the user experience associated with the vacuum cleaner 10, 10A, as the battery 70 is removed in fewer steps than known hand vacuums that engage and power vacuum components, such as the upright portion 20. These and other advantages may be realized from one or more embodiments of the vacuum cleaner 10, 10A disclosed herein.

What is claimed is:

1. A vacuum cleaner comprising:

a nozzle;

a handle pivotably connected to the nozzle; and a hand vacuum including a suction source and a battery, the hand vacuum removably attached to the handle such that the hand vacuum pivots with the handle relative to the nozzle when the hand vacuum is attached to the handle, wherein the battery is removable from the hand vacuum while the hand vacuum remains attached to the handle.

2. The vacuum cleaner of claim 1, wherein the nozzle includes a dirty air inlet, the suction source is in fluid communication with the dirty air inlet when the hand vacuum is attached to the handle.

3. The vacuum cleaner of claim 2, wherein an airflow generated by the suction source transports dirty air from the dirty air inlet into the hand vacuum.

4. The vacuum cleaner of claim 1, wherein the handle includes a first side opposite a second side, the hand vacuum being configured to removably engage the first side of the handle, and the battery is configured to be removable from the second side of the handle.

5. The vacuum cleaner of claim 1, wherein the battery is configured to be removable from the hand vacuum through the handle while the hand vacuum remains attached to the handle.

6. The vacuum cleaner of claim 1, wherein the battery is a rechargeable battery.

7. The vacuum cleaner of claim 1, wherein the handle at least partially defines a passage.

8. The vacuum cleaner of claim 7, wherein the battery is configured to be removable through the passage while the hand vacuum remains attached to the handle.

9. The vacuum cleaner of claim 1, wherein the handle includes a cradle, the hand vacuum is removably received by the cradle.

10. The vacuum cleaner of claim 9, wherein the battery is configured to be removable from the hand vacuum while the hand vacuum remains received by the cradle.

11. A vacuum cleaner comprising:

a vacuum component that includes a handle and a nozzle defining a dirty air inlet; and a hand vacuum that is removably coupled to the vacuum component, the hand vacuum carries a power source, wherein the power source is removable from the hand vacuum while the hand vacuum remains coupled to the vacuum component.

12. The vacuum cleaner of claim 11, wherein the hand vacuum is removably coupled to the vacuum component at a position between the dirty air inlet and the handle.

13. The vacuum cleaner of claim 11, wherein the handle is pivotably connected to the nozzle, the hand vacuum is configured to pivot with the handle relative to the nozzle when coupled to the vacuum component.

14. The vacuum cleaner of claim 11, wherein the power source is a rechargeable battery.

15. The vacuum cleaner of claim 11, wherein the vacuum component is configured to receive power from the power source when the hand vacuum is removably coupled to the vacuum component.

16. The vacuum cleaner of claim 11, wherein the power source is removable from the hand vacuum through a portion of the vacuum component while the hand vacuum remains coupled to the vacuum component.

17. The vacuum cleaner of claim 11, wherein the vacuum component includes a cradle that is configured to receive the hand vacuum.

18. The vacuum cleaner of claim 11, wherein the vacuum component at least partially defines a passage that extends through a portion of the vacuum component.

19. The vacuum cleaner of claim 18, wherein the power source is removable through the passage while the hand vacuum remains coupled to the vacuum component.

20. The vacuum cleaner of claim 11, wherein the hand vacuum is removably coupled to a first side of the vacuum component, and the power source is removable from a second side of the vacuum component, the first side being positioned opposite the second side.

* * * * *